US009388673B2

(12) United States Patent
Grove et al.

(10) Patent No.: US 9,388,673 B2
(45) Date of Patent: Jul. 12, 2016

(54) INTERNALLY PRESSURIZED PERFORATING GUN

(75) Inventors: Brenden M. Grove, Missouri City, TX (US); Jeremy P. Harvey, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 684 days.

(21) Appl. No.: 13/294,274

(22) Filed: Nov. 11, 2011

(65) Prior Publication Data

US 2013/0118745 A1 May 16, 2013

(51) Int. Cl.
*E21B 43/116* (2006.01)
*E21B 43/1185* (2006.01)

(52) U.S. Cl.
CPC ..... *E21B 43/11852* (2013.01); *E21B 43/116* (2013.01)

(58) Field of Classification Search
CPC .. E21B 43/11; E21B 43/116; E21B 43/11852
USPC ..... 166/297, 55.2
See application file for complete search history.

(56) References Cited

U.S. PATENT DOCUMENTS

| | | | | |
|---|---|---|---|---|
| 8,286,706 | B2 | 10/2012 | McCann et al. | |
| 2004/0089450 | A1* | 5/2004 | Slade et al. | 166/298 |
| 2005/0178551 | A1* | 8/2005 | Tolman et al. | 166/297 |
| 2009/0078144 | A1 | 3/2009 | Behrmann et al. | |
| 2009/0078420 | A1 | 3/2009 | Caminari et al. | |

* cited by examiner

*Primary Examiner* — Brad Harcourt
(74) *Attorney, Agent, or Firm* — Tuesday Kaasch

(57) ABSTRACT

A technique facilitates a perforation operation. A perforating gun carrier is combined with a pressure enhancement mechanism. The pressure enhancement mechanism provides a controlled increase in pressure within the perforating gun carrier as the perforating gun carrier is delivered into a higher pressure environment. The increase in internal pressure counters the buildup of a pressure differential to the degree desired for a given perforating gun carrier.

17 Claims, 3 Drawing Sheets

INTERNALLY PRESSURIZED PERFORATING GUN

BACKGROUND

In a well perforating operation, a perforating gun string is used to carry a perforating gun downhole into a wellbore to a desired region. The perforating gun comprises a carrier tube designed to carry a plurality of charges which are detonated to form perforations that extend outwardly in a radial direction into a surrounding formation. As the carrier tube is conveyed deeper into the wellbore, a substantial pressure differential is established between the high pressure external well environment and the interior of the carrier tube. The high differential pressure increases both the collapse tendency and the leak potential of the carrier. Following perforation, the differential pressure also can drive well fluid into the perforating gun and cause a detrimental pressure pulse which propagates through the wellbore fluid.

SUMMARY

In general, the present disclosure provides a methodology and system which facilitate a perforation operation. A perforating gun carrier is combined with a pressure enhancement mechanism. The pressure enhancement mechanism enables a controlled increase in pressure within the perforating gun as the perforating gun carrier is delivered into a higher pressure environment. The increase in internal pressure counters the buildup of a pressure differential to the degree desired for a given perforating gun carrier.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

Figure 1:
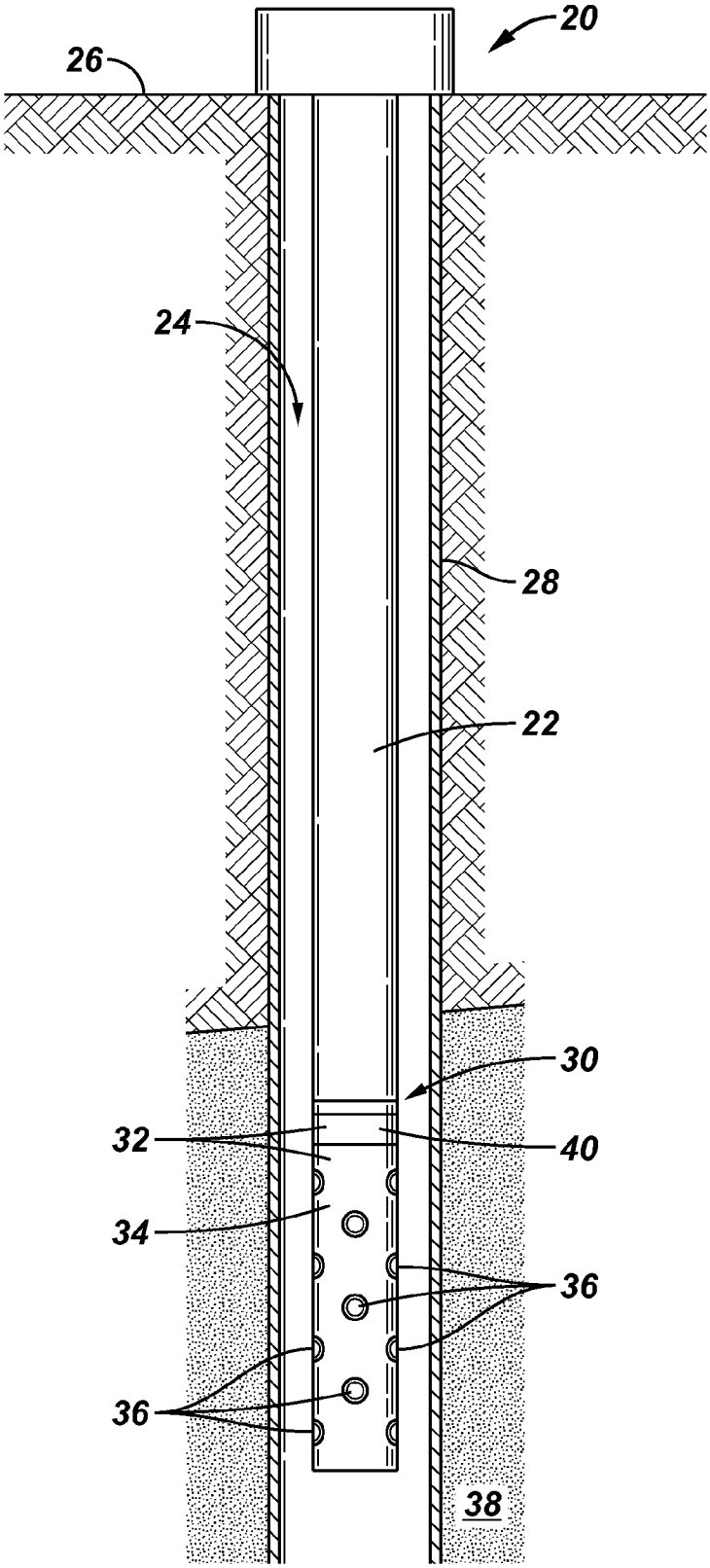
FIG. 1 is a schematic illustration of an example of a perforating gun string, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology which can be employed to alleviate the detrimental effects of differential pressures acting on a hollow body during a perforating operation. In downhole perforating operations, for example, the perforating gun carrier is subjected to high downhole wellbore pressures which can create detrimental differential pressures between the exterior and interior of the perforating gun carrier. According to an embodiment of the present system and methodology the static pressure differential in a perforating gun carrier is reduced prior to shooting, thus reducing the collapse tendency of the carrier and also reducing the leak potential of sealing elements. The increased in-gun pressure also reduces the influx of wellbore fluid which would otherwise enter into the perforating gun carrier due to the pressure differential. Consequently, perforating gun filling and the resulting pressure pulse propagating through the wellbore fluid are eliminated or adequately reduced. Eliminating or adequately reducing the pressure pulse removes a variety of detrimental effects, e.g. excessive stresses, which would otherwise act against the well equipment.

In perforating applications, the interior pressure within the perforating gun carrier can be increased in a controlled manner to reduce or eliminate the pressure differential between the interior and the exterior of the gun carrier. By way of example, pressure in the interior of the perforating gun carrier may be increased by a pressure enhancement mechanism carried by the perforating gun string. An example of a pressure enhancement mechanism comprises an internal gas generator, such as a propellant charge. In another example of a pressure enhancement mechanism, the interior pressure may be increased through activation of a subcritical fluid, e.g. CO2, at the downhole temperature. Additionally, the interior pressure may be controlled by a pressure enhancement mechanism which releases compressed gas from a compressed gas chamber working in cooperation with the gun carrier.

In many applications, the pressurization occurs after the gun carrier is placed in a wellbore. For example, the controlled pressurization can be executed downhole on a continuous basis as the perforating gun carrier is lowered to a desired perforating region along a surrounding formation. The pressurization also may be performed within the perforating gun carrier in discrete steps, e.g. at sequential, discrete locations along the wellbore, as the perforating gun is conveyed downhole to the desired perforating region.

Perforating operations can be performed in many types of downhole applications and in other applications via several types of perforating guns. For example, some perforating guns comprise a perforating gun carrier, such as a perforating gun carrier tube, which is designed to hold charges that are selectively detonated to form perforations in the surrounding structures. According to an embodiment, a perforating gun string is provided with a perforating gun carrier and the carrier is conveyed downhole into a wellbore. During conveyance, pressure is increased within the perforating gun carrier via the pressure enhancement mechanism. The pressure enhancement mechanism may be carried by the perforating gun string and is designed to provide a controlled increase in pressure during the conveyance downhole.

Referring generally to FIG. 1, an example of one type of application for facilitating a perforating operation is illustrated. The example is provided to facilitate explanation, and it should be understood that a variety of perforating gun strings and systems may be used in a variety of well related applications as well as in many types of non-well related applications in which perforations are to be formed. The perforating gun string and other structures described herein may comprise many types of components arranged in various configurations depending on the parameters of a specific perforating application.

In FIG. 1, an embodiment of a perforating system 20 is illustrated as comprising a perforating gun carrier string 22 positioned in a wellbore 24 extending from a surface location 26. In some applications, the wellbore 24 is cased with a well casing 28. The perforating gun carrier string 22 comprises a perforating gun 30 having a perforating gun carrier assembly 32. The perforating gun carrier assembly 32 comprises a perforating gun carrier 34, e.g. a perforating gun carrier tube, designed to hold a plurality of charges 36. Depending on the specific application, the charges 36 may comprise shaped charges constructed and oriented to form precise perforations that extend radially outward through the casing 28 and into a surrounding formation 38. In the example illustrated, the perforating gun carrier assembly 32 also comprises a pressure enhancement mechanism 40 which may be carried by perforating gun carrier string 22 at a location within the perforating gun carrier 34 and/or at a position external to perforating gun carrier 34. It should be noted that in well related applications, wellbore 24 may comprise many types of wellbores, including deviated, e.g. horizontal, single bore, multilateral, cased, and uncased (open bore) wellbores.

Figure 2:
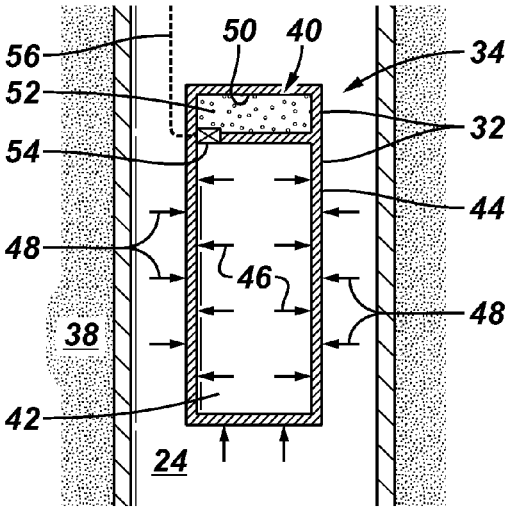
FIG. 2 is an illustration of a perforating gun carrier, according to an embodiment of the disclosure.

Referring generally to FIG. 2, an embodiment of a perforating gun carrier 34 is illustrated. In this embodiment, perforating gun carrier 34 comprises an interior 42 separated from an exterior environment, e.g. a wellbore environment, by a gun carrier wall 44. In at least some applications, the carrier wall 44 is arranged in a tubular form with charges 36 mounted to orient the perforations in a radially outward direction. The pressure enhancement mechanism 40 is mounted to enable a controlled increase in pressurization of interior 42, as indicated by arrows 46. The increase in pressurization of interior 42 is selectively controlled to counter or to eliminate the differential in pressure between the internal pressure 46 and an external pressure represented by arrows 48.

For example, pressure enhancement mechanism 40 may be designed to enable selective release of gas into interior 42 to provide control over the pressure differential, e.g. to provide a reduction of the pressure differential between internal pressure 46 and external pressure 48. In a variety of well applications, the internal pressure represented by arrows 46 can be increased while the perforating gun carrier 34 is in wellbore 24. By way of example, the internal pressure may be increased gradually and continuously as the perforating gun carrier 34 is deployed downhole along wellbore 24. In another example, the internal pressure may be increased periodically in discrete steps during conveyance of perforating gun carrier 34 downhole. The amount of pressure increase may be determined based on the collapse resistance of the perforating gun carrier 34 and/or based on other application related parameters.

Referring again to FIG. 2, the illustrated example of a pressure enhancement mechanism 40 comprises a chamber 50 containing a pressurized gas 52. The chamber 50 may be placed in operative cooperation with interior 42 of perforating gun carrier 34 to selectively release the high pressure gas 52 into interior 42 to decrease or eliminate the differential pressure acting on perforating gun carrier 34. The chamber 50 may be carried by perforating gun string 22 and may be placed proximate, e.g. adjacent, the perforating gun carrier 34. In this example, the pressure enhancement mechanism 40 also comprises a gas release member 54 which may be selectively activated to provide a controlled release of pressurized gas 52 from chamber 50 and into interior 42 of perforating gun carrier 34. By way of example, the gas release member 54 comprises a valve or other actuatable member which may be actuated, for example, electrically or hydraulically via input from a control line 56. However, the gas release member 54 may comprise other types of mechanisms, such as passive release mechanisms in the form of spring-loaded members and/or a series of rupture discs. In other embodiments, the gas release member 54 may comprise a timed release mechanism, a pressure activated mechanism, or another suitable gas release mechanism to provide for controlled increase of pressure within interior 42.

Figure 3:
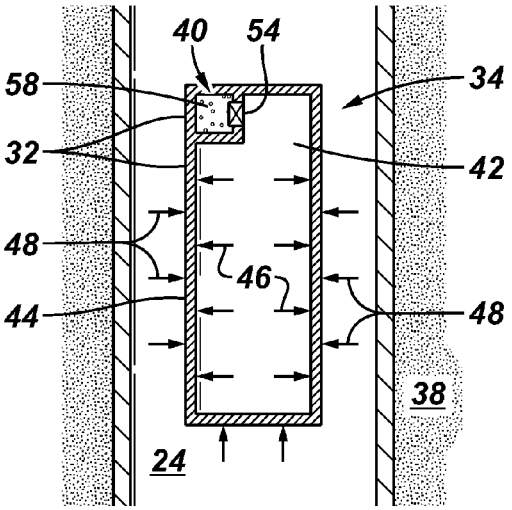
FIG. 3 is an illustration of another example of a perforating gun carrier, according to an embodiment of the disclosure.

In another example, the pressure enhancement mechanism 40 comprises a gas generator 58, as illustrated in FIG. 3. The gas generator 58 may be selectively activated to release gas into interior 42 and to thus raise the internal pressure, thereby reducing the pressure differential between the internally acting pressure 46 and the externally acting pressure 48. In some applications, the gas generator 58 may be located at an internal location within perforating gun carrier 34. By way of example, the gas generator 58 may comprise a propellant charge which is selectively activated to release gas and to increase the pressure within interior 42. In another example, the gas generator 58 may comprise a subcritical fluid, e.g. $CO_2$, which is activated at downhole temperature. Depending on the specific type of gas generator 58, a corresponding gas release member 54 may be used to selectively initiate activation of the gas generator 58 for release of the gas within interior 42.

Figure 4:
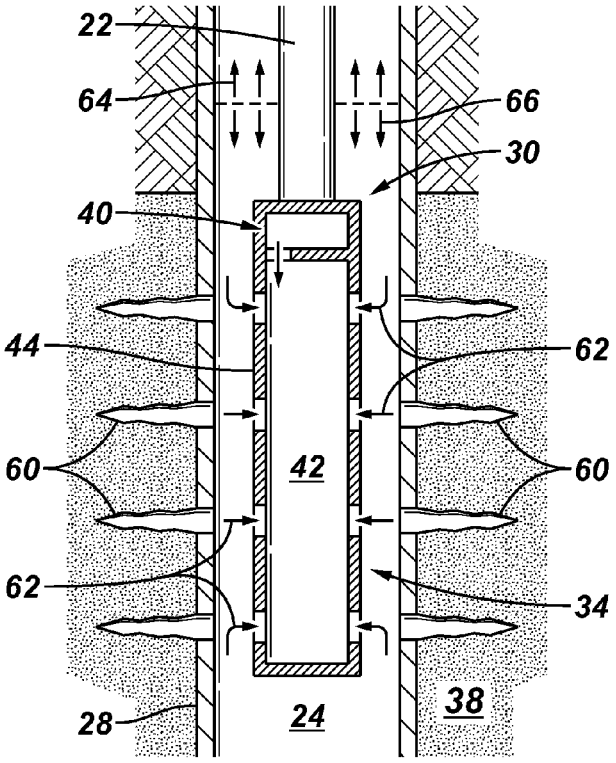
FIG. 4 is a schematic illustration of a perforating operation, according to an embodiment of the disclosure.

Referring generally to FIG. 4, an illustration is provided of the perforating gun carrier 34 following detonation of charges 36 to form a plurality of perforations 60. As illustrated, the perforations 60 may be formed in a radially outward direction through casing 28 and into the surrounding formation 38. By increasing the pressure within interior 42 as the perforating gun carrier 34 is moved downhole, the collapse tendency of the perforating gun carrier 34 is reduced and the potential for a detrimental post-shot pressure pulse is reduced or eliminated. The amount of pressure increase may be determined according to collapse resistance, leak resistance, and/or susceptibility to damage from the post-shot pressure pulse. Depending on the parameters of a specific application and environment, the internal pressure, represented by arrows 46 in FIGS. 2 and 3, may be sufficiently increased to reduce an underbalance pressure situation; to equalize internal and external pressures; or to create an overbalance pressure situation in which the internal pressure is greater than the external pressure.

Internal perforating gun carrier post-shot pressures also are affected by the explosive detonation gas density and temperature resulting from detonation of charges 36. The addition of gas 52 and the resulting increase of internal pressure via activation of pressure enhancement mechanism 40 further increase the post-shot gas density and thus further increase the post-shot pressure acting against the influx of well fluid (see arrows 62) and against the resultant detrimental pressure pulse. In FIG. 4, a pressure pulse is illustrated by arrows 64 as propagating away from perforating gun carrier 34. Similarly, a corresponding decompression wave is illustrated by arrows 66. The introduction of additional gas 52 and higher internal pressures via pressure enhancement mechanism 40 enables better control over or even elimination of these effects caused by detonation of charges 36.

Figure 5:
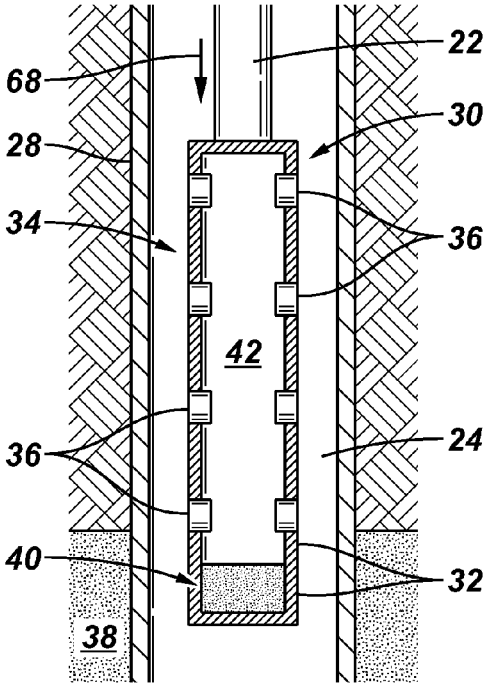
FIG. 5 is an illustration of a perforating gun carrier on a perforating gun string during an initial stage of conveyance downhole, according to an embodiment of the disclosure.
Figure 6:
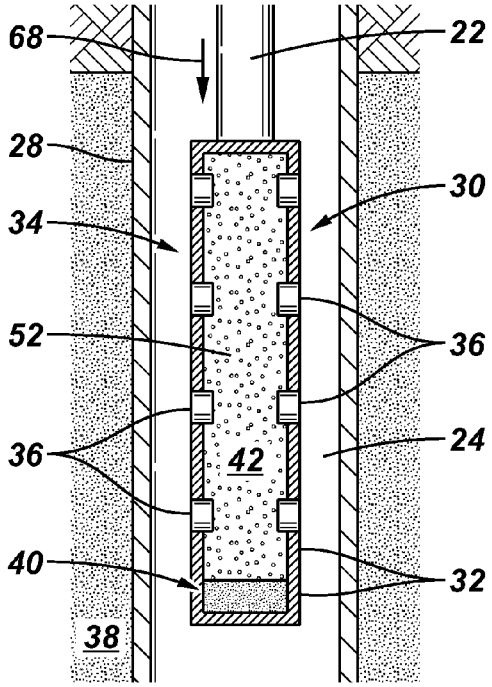
FIG. 6 is an illustration of a perforating gun carrier on a perforating gun string similar to that of FIG. 5 but during a subsequent stage of conveyance downhole, according to an embodiment of the disclosure.
Figure 7:
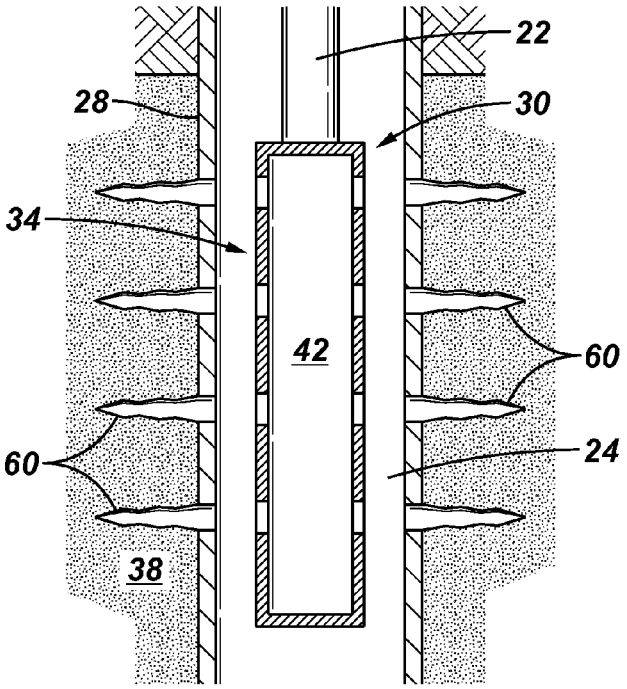
FIG. 7 is an illustration of a perforating gun carrier on a perforating gun string similar to that of FIG. 5 but positioned at a perforating region, according to an embodiment of the disclosure.

In operation, the pressure level in interior 42 of perforating gun carrier 34 (and thus the pressure differential acting on the perforating gun carrier 34) may be selectively controlled during conveyance of the perforating gun 30 downhole or to another desired perforating region. As illustrated in FIGS. 5-7, a controlled increase in pressure within perforating gun carrier 34 is provided during conveyance of the perforating gun carrier 34 downhole into wellbore 24 via perforating gun string 22. Referring to FIG. 5, the pressure enhancement mechanism 40 may be initially activated once the perforating gun carrier 44 is moved down to a desired position within wellbore 24, as indicated by arrow 68.

During conveyance to greater depths downhole, additional gas 52 is released to increase the pressure within perforating gun carrier 34, as illustrated in FIG. 6. As discussed above, the release of gas may be conducted continually or periodically at discrete locations as the perforating gun carrier 34 is lowered downhole. The increased internal pressure within interior 42 reduces the pressure differential acting on perforating gun carrier 34, thus enhancing collapse survivability while also inhibiting leaks into the perforating gun carrier 34.

Once the perforating gun 30 is at a desired perforating region along formation 38 and once the internal pressure created via pressure enhancement mechanism 40 is at a desired level, the charges 36 are detonated to create perforations 60 as illustrated in FIG. 7. When the perforating gun 30 is fired, in-gun pressure is increased above what it otherwise would be due to the post-detonation gas pressure created by the explosion/heat of the detonated charges 36. This increase in pressure plus the pre-shot static pressure established by the controlled release of gas 52 via pressure enhancement mechanism 40 eliminates or minimizes the severity of perforating gun filling and thus eliminates or minimizes the magnitude of the resultant pressure pulse.

The system and methodology described herein may be employed in non-well related perforation applications which subject the perforating gun to pressure differentials. The type of perforating gun and charges employed may vary depending on the specific application and environment in which the perforating application is carried out. In some applications, the explosive charges 36 can be replaced with other types of perforating devices or techniques, such as high pressure jet perforating tools.

Additionally, the system and methodology may be employed in many types of well applications, including many types of single zone or multi-zone perforating applications. Single gas generating devices or a plurality of gas generating devices may be used in cooperation with each perforating gun carrier. Additionally, the size and construction of the perforating gun carrier can vary depending on the specific parameters of a given application and/or environment. Furthermore, the perforating gun may be combined with several types of additional devices and systems to carry out other functions at the perforating region. For example, a variety of chemical treatment devices or other well treatment related devices may be combined with the perforating string to carry out desired service operations in the well environment or in another perforating environment.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for facilitating a perforation operation in a wellbore, comprising:

preparing a perforating gun carrier string with a perforating gun carrier;

conveying the perforating gun carrier downhole into a wellbore; and selectively and periodically increasing the pressure within the perforating gun carrier via a pressure enhancement mechanism, carried by the perforating gun string, as the perforating gun carrier is moved downhole through the wellbore.

2. The method as recited in claim 1, further comprising detonating perforating charges to create perforations in a surrounding formation once the perforating gun carrier has been conveyed to a desired perforating region.

3. The method as recited in claim 2, wherein increasing comprises increasing the pressure to a level sufficient to reduce a detrimental pressure pulse otherwise resulting from inflow of well fluid into the perforating gun carrier following detonation of the perforating charges.

4. The method as recited in claim 1, wherein increasing comprises increasing pressure within the perforating gun carrier to a level above the external pressure acting on the perforating gun carrier.

5. The method as recited in claim 1, wherein increasing comprises increasing the pressure with an internal gas generator.

6. The method as recited in claim 1, wherein increasing comprises increasing the pressure via the release of compressed gas from a chamber proximate the perforating gun carrier.

7. The method of claim 1, wherein increasing comprises increasing the pressure via activation of a subcritical fluid at downhole temperature.

8. A method for perforating, comprising:

determining a collapse resistance of a perforating gun carrier;

conveying the perforating gun carrier downhole into a wellbore to a desired perforation location;

selectively and in discrete increments_increasing pressure within the perforating gun carrier while in the wellbore and prior to reaching the desired perforation location to enhance the collapse resistance; and perforating a formation surrounding the perforating gun carrier.

9. The method as recited in claim 8, wherein increasing pressure comprises utilizing a pressure enhancement mechanism to release a gas to an interior of the perforating gun carrier.

10. The method as recited in claim 9, wherein increasing pressure comprises utilizing an internal gas generator.

11. The method as recited in claim 9, wherein increasing pressure comprises increasing pressure via release of compressed gas from a cooperating chamber.

12. The method as recited in claim 9, wherein increasing pressure comprises increasing the pressure to a level sufficient to eliminate detrimental pressure pulse effects due to flow back of fluid into the perforating gun carrier following perforating.

13. The method as recited in claim 9, wherein increasing pressure comprises increasing pressure continuously as the perforating gun carrier is moved downhole.

14. The method of claim 8, wherein increasing comprises increasing the pressure via activation of a subcritical fluid at downhole temperature.

15. A system to facilitate perforating, comprising:

a perforating gun assembly having a perforating gun carrier and a plurality of perforating gun charges; and a pressure enhancement mechanism coupled to the perforating gun carrier to selectively release gas into an interior of the perforating gun carrier so as to provide a controlled increase in pressure as the perforating gun carrier is delivered into a higher pressure environment, wherein the pressure enhancement mechanism comprises a subcritical fluid activatable at downhole temperature, wherein increasing comprises continuously increasing the pressure.

16. The system as recited in claim 15, wherein the pressure enhancement mechanism comprises a propellant charge.

17. The system as recited in claim 15, wherein the pressure enhancement mechanism comprises an adjacent chamber filled with the gas under pressure.

* * * * *